US007473026B2

(12) United States Patent
Clawson et al.

(10) Patent No.: US 7,473,026 B2
(45) Date of Patent: Jan. 6, 2009

(54) METHOD FOR CLEANING A ROTARY MIXING DEVICE WITH A CLEANING SHIELD

(75) Inventors: Ross Clawson, Bellingham, WA (US); Randy Hansen, Bellingham, WA (US); Jane Wasley, Ferndale, WA (US)

(73) Assignee: Site-b Company, Bellingham, WA (US)

( * ) Notice: Subject to any disclaimer, the term of this patent is extended or adjusted under 35 U.S.C. 154(b) by 0 days.

(21) Appl. No.: 12/082,126

(22) Filed: Apr. 8, 2008

(65) Prior Publication Data

US 2008/0247267 A1 Oct. 9, 2008

Related U.S. Application Data

(60) Provisional application No. 60/910,741, filed on Apr. 9, 2007.

(51) Int. Cl.
*B01F 15/00* (2006.01)
*B08B 7/00* (2006.01)

(52) U.S. Cl. ..... 366/347; 366/129; 366/605; 134/33; 134/38

(58) Field of Classification Search ..... 366/129, 366/130, 262, 263, 265, 270, 315–317, 342–343, 366/347, 348, 605; 416/178, 184, 187; 134/33, 134/38, 149, 900; 220/731
See application file for complete search history.

(56) References Cited

U.S. PATENT DOCUMENTS 59,493 A * 11/1866 Willcox ..... 366/343
1,412,401 A * 4/1922 Gotfredsen ..... 366/251
2,619,330 A * 11/1952 Willems ..... 366/263
2,655,436 A * 10/1953 Bishop et al. ..... 422/225
2,681,211 A * 6/1954 Reynolds ..... 366/251
2,724,547 A * 11/1955 Abbott et al. ..... 416/184
2,736,537 A * 2/1956 Nelsson ..... 416/199
2,753,162 A * 7/1956 Conley ..... 416/175
2,803,398 A * 8/1957 Sprouse ..... 416/187
2,879,044 A * 3/1959 Gunas ..... 416/185
3,147,957 A * 9/1964 Martin ..... 366/263
3,166,303 A * 1/1965 Chapman ..... 366/129
3,319,940 A * 5/1967 Mentnech ..... 416/131
3,362,338 A * 1/1968 Stethem ..... 416/183
3,362,689 A * 1/1968 Rothman et al. ..... 366/304
3,387,832 A * 6/1968 Nelson ..... 261/93
3,423,075 A * 1/1969 Munjee et al. ..... 366/181.1
3,464,622 A * 9/1969 Dennis ..... 416/178

(Continued)

FOREIGN PATENT DOCUMENTS

DE 2225800 * 7/1980

(Continued)

*Primary Examiner*—Charles E Cooley
(74) *Attorney, Agent, or Firm*—Weide & Miller, Ltd.

(57) ABSTRACT

In a method of cleaning a rotary mixing device having a mixer portion and a driving shaft, a shield is located over at least the mixer portion. The mixing device is rotated, expelling material clinging to or trapped by the mixing portion, such as paint, from the mixer portion of the mixing device. This material is blocked or caught by the shield. In one embodiment, the shield is cylindrical in shape and has a base with an opening through which the shaft of the mixing device may extend, and an open second end leading to an interior area for containing the mixer portion of the mixing device.

4 Claims, 7 Drawing Sheets

U.S. PATENT DOCUMENTS 3,521,973 A * 7/1970 Schouw ..... 416/185
3,690,621 A * 9/1972 Tanaka et al. ..... 366/265
3,733,645 A * 5/1973 Seiler ..... 15/257.01
3,846,043 A * 11/1974 Wolbrink et al. ..... 416/183
3,920,227 A * 11/1975 Davis, Jr. ..... 366/329.1
3,942,770 A * 3/1976 Belouet et al. ..... 366/343
3,972,512 A * 8/1976 Grise et al. ..... 366/129
4,159,191 A * 6/1979 Graybill ..... 416/11
4,163,616 A * 8/1979 Claunch ..... 366/262
4,175,875 A * 11/1979 Van Horbek ..... 366/343
4,444,510 A * 4/1984 Janssen ..... 366/170.3
4,451,155 A * 5/1984 Weber et al. ..... 366/265
4,472,063 A * 9/1984 Eickelmann ..... 366/129
4,483,624 A * 11/1984 Bacon et al. ..... 366/293
4,534,657 A * 8/1985 Clement ..... 366/265
4,538,922 A * 9/1985 Johnson ..... 366/318
4,738,593 A * 4/1988 Reifschneider ..... 416/178
4,893,941 A * 1/1990 Wayte ..... 366/265
4,900,159 A * 2/1990 Jamison ..... 366/343
4,948,262 A * 8/1990 Tome, Jr. ..... 366/129
5,073,033 A * 12/1991 Klepeis ..... 366/343
5,251,979 A * 10/1993 Larsen ..... 366/248
5,257,902 A * 11/1993 Atarashi et al. ..... 415/119
5,261,745 A * 11/1993 Watkins ..... 366/250
5,314,310 A * 5/1994 Bachellier ..... 416/201 A
5,417,493 A * 5/1995 Ericson ..... 366/343
5,556,203 A * 9/1996 Filias ..... 366/347
5,575,562 A * 11/1996 Borgia ..... 366/347
5,766,665 A * 6/1998 Miller ..... 426/565
5,865,539 A * 2/1999 Rogers ..... 366/325.8
5,938,332 A * 8/1999 Bachellier ..... 366/330.1
5,984,518 A * 11/1999 King et al. ..... 366/129
5,988,979 A * 11/1999 Wang ..... 416/178
6,012,473 A * 1/2000 Koyama ..... 134/149
6,062,721 A * 5/2000 King et al. ..... 366/129
6,068,395 A * 5/2000 Ondracek ..... 366/129
6,193,405 B1 * 2/2001 King et al. ..... 366/129
6,257,753 B1 * 7/2001 King et al. ..... 366/129
6,286,989 B1 * 9/2001 King ..... 366/129
6,315,441 B2 * 11/2001 King ..... 366/129
6,325,532 B1 * 12/2001 King et al. ..... 366/129
6,431,741 B2 * 8/2002 King et al. ..... 366/129
6,446,648 B1 * 9/2002 King ..... 134/140
6,520,672 B1 * 2/2003 Whitney ..... 366/129
6,523,995 B2 * 2/2003 Fasano et al. ..... 366/264
6,543,927 B2 * 4/2003 King et al. ..... 366/129
6,634,785 B2 * 10/2003 French et al. ..... 366/347
6,688,764 B2 * 2/2004 King ..... 366/129
6,736,538 B2 * 5/2004 Bittner ..... 366/199
6,776,518 B2 * 8/2004 Gartland et al. ..... 366/348
6,818,071 B2 * 11/2004 King ..... 134/33
6,848,823 B2 * 2/2005 King et al. ..... 366/129
6,902,315 B2 * 6/2005 Hutchinson ..... 366/343
6,971,788 B1 * 12/2005 Gringer et al. ..... 366/265
6,997,444 B2 * 2/2006 Weetman et al. ..... 261/91
7,070,317 B2 * 7/2006 King ..... 366/129
7,144,150 B2 * 12/2006 Farrell ..... 366/197
7,226,205 B2 * 6/2007 Gringer et al. ..... 366/265
7,229,206 B2 * 6/2007 Whitney ..... 366/129
7,334,936 B2 * 2/2008 King ..... 366/129
7,422,363 B2 * 9/2008 Parker ..... 366/325.4
2001/0010658 A1 * 8/2001 King ..... 366/129
2001/0046180 A1 * 11/2001 King et al. ..... 366/129
2002/0015357 A1 * 2/2002 Langevin et al. ..... 366/347
2002/0024885 A1 * 2/2002 King ..... 366/129
2002/0181320 A1 * 12/2002 King et al. ..... 366/129
2003/0095469 A1 * 5/2003 King ..... 366/129
2003/0107950 A1 * 6/2003 Shepherd et al. ..... 366/317
2003/0112700 A1 * 6/2003 King et al. ..... 366/129
2004/0085856 A1 * 5/2004 Murosako ..... 366/262
2004/0160854 A1 * 8/2004 King ..... 366/129
2005/0047268 A1 * 3/2005 Chen ..... 366/129
2005/0195683 A1 * 9/2005 King et al. ..... 366/129
2006/0083106 A1 * 4/2006 Gringer et al. ..... 366/263
2006/0262637 A1 * 11/2006 King ..... 366/129
2007/0086271 A1 * 4/2007 Hamilton ..... 366/325.2
2007/0297277 A1 * 12/2007 Tytar ..... 366/134

FOREIGN PATENT DOCUMENTS

DE 3245641 A1 * 6/1984
DE 3616203 * 11/1987
DE 29805820 * 8/1998
DE 10134316 A1 * 1/2003
EP 1398071 A2 * 3/2004
FR 1151512 * 1/1958
FR 2385439 * 3/1977
FR 2605532 * 4/1988
GB 1064111 * 4/1967
GB 1206074 * 9/1970
JP 58-224637 * 12/1983
WO WO 97/20623 12/1996
WO WO 9720623 A1 * 6/1997
WO WO 01/60505 2/2001
WO 02/22247 A1 * 3/2002

* cited by examiner

METHOD FOR CLEANING A ROTARY MIXING DEVICE WITH A CLEANING SHIELD

RELATED APPLICATION DATA

This application claims priority to U.S. Provisional Application Ser. No. 60/910,741, filed Apr. 9, 2007.

FIELD OF THE INVENTION

The present invention relates to methods and devices for cleaning mixing devices.

BACKGROUND OF THE INVENTION

The mixing of viscous fluids has historically been a difficult task. Present methods of mixing such fluids often result in inadequate mixing and are time-consuming and energy consumptive. One of the more common viscous fluids which must be mixed is paint. Homeowners and painters are all too familiar with the task of mixing paint.

Probably the most common method of mixing fluid such as paint involves the user opening the container, inserting a stir stick or rod and rotating or moving the stick about the container. This method is tiring, requiring tremendous effort to move the stir stick through the viscous fluid. Because of this, individuals often give up and stop mixing long before the paint is adequately mixed. Further, even if the individual moves the stir stick for a long period of time, there is no guarantee that the paint is thoroughly mixed, rather than simply moved about the container.

U.S. Pat. No. 7,070,317 represents one solution to mixing such fluids. This patent details various configurations of rotary mixing devices. While these mixers are very effective in mixing fluids, there is needed an efficient and effective way of cleaning these mixers.

SUMMARY OF THE INVENTION

The present invention is a method and device for cleaning a mixing device. The method and device have particular applicability to cleaning of a rotary mixing device having a mixing cage or portion and a shaft or other drive element extending therefrom.

One embodiment of the invention is a shield. In one embodiment, the shield is cylindrical in shape and has a generally closed first end or base. The base preferably has an opening for accepting the shaft or drive element of a mixing device there through. The shield also has an open second end leading to an interior area for containing the mixer portion of the mixing device.

In one embodiment of a method, a shield is located over at least the mixer portion of the mixing device. The shaft or other drive element of the mixing device may be extended through the opening in the base of the shield. The mixing device is activated, such as to cause it to rotate. This expels material clinging to or trapped by the mixing portion, such as paint, from the mixer portion of the mixing device. This material is blocked or caught by the shield.

The method and device of the invention are applicable to a wide range of mixing devices. In one embodiment, the method and device may be utilized to clean a mixing device including a mixing cage connected to a shaft. The shaft is elongate, having a first end connected to the mixing cage, and a second or free end for connection to the rotary drive means. The mixing cage comprises a plurality of vanes configured to rotate with the shaft.

Further objections, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Generally, the invention comprises a method and device for cleaning a mixing device. The method and device have particular applicability to rotary mixing devices, such as of the type having a mixing cage or mixing portion which is rotated via a drive element by a shaft or drive member.

Figure 1:
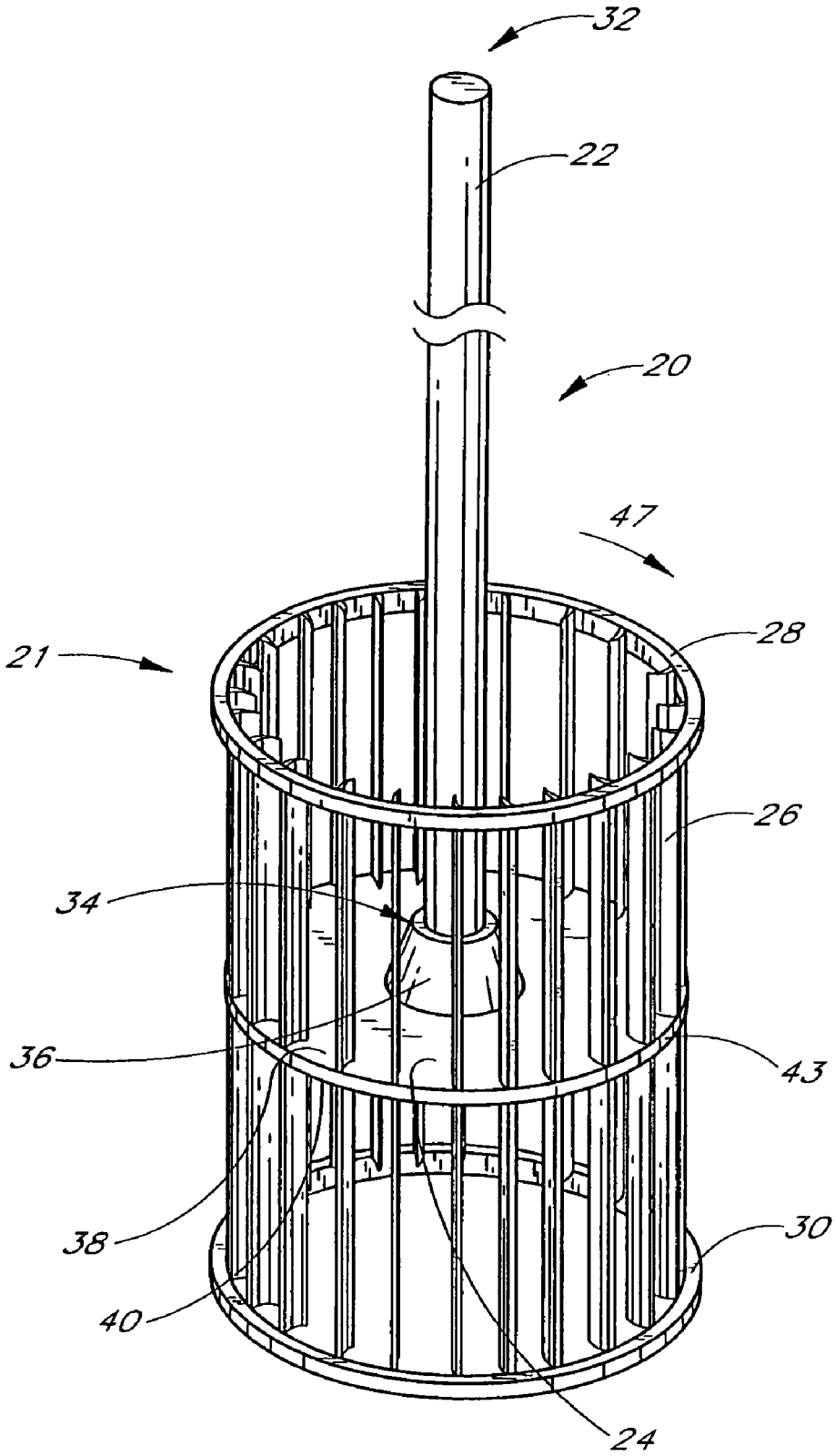
FIG. 1 is a perspective view of a mixing device in accordance with a first embodiment of the invention for use in the method of the present invention.

FIG. 1 illustrates one mixing device 20 of the type to which the present invention is applicable. The device 20 includes mixing cage 21 connected to a shaft 22. As illustrated, the mixing cage 21 comprises a central connecting plate 24, vanes 26, and two hoops 28, 30. The shaft 22 is an elongate rigid member having a first end 32 and second end 34. The second end 34 of the shaft 22 is connected to the central plate 24. The second end 34 of the shaft 22 engages an adapter 36 connected to the plate 24. The shaft end 34 engages the plate 24 at the center point of the plate 24. The central plate 24 comprises a flat, disc-shaped member having a top surface 38, bottom surface 40 and outer edge 43. The shaft 22 engages the plate 24 at the top surface 38 thereof.

Figure 3:
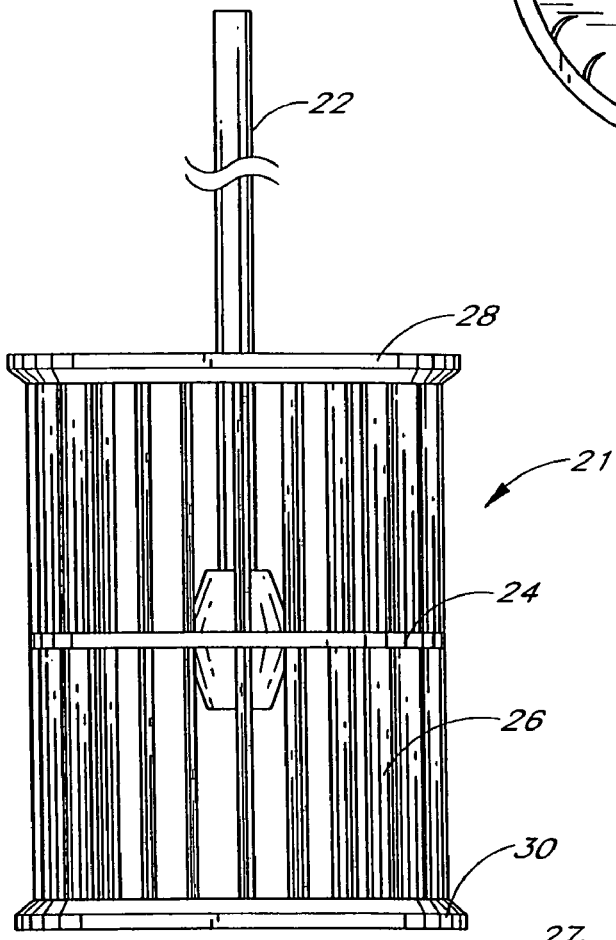
FIG. 3 is a side view of the mixing device illustrated in FIG. 1.

A number of vanes 26 extend from the top and bottom surface 38, 40 respectively, of the plate 24 or support near the outer edge 43 or periphery thereof. Each vane 26 has a first or inner edge and second or outer edge, being curved therebetween. As illustrated in FIGS. 1 and 3, although the vanes 26 are curved, the inner and outer edges thereof are generally aligned in a radial direction from the shaft 22 or from an axis along which the shaft extends.

Figure 2:
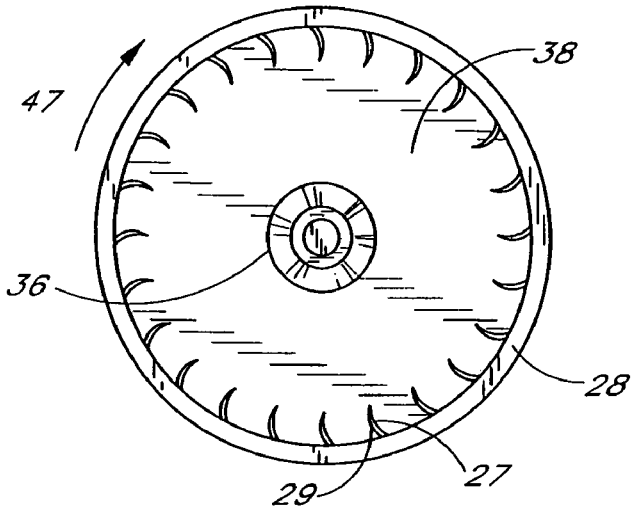
FIG. 2 is a top view of the mixing device illustrated in FIG. 1.
Figure 4:
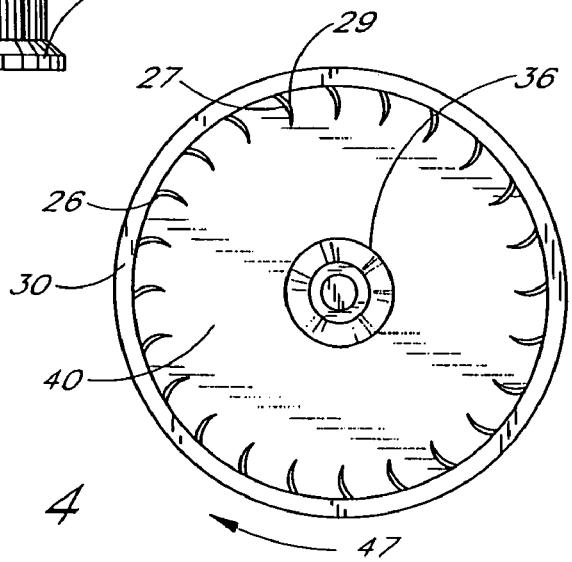
FIG. 4 is a bottom view of the mixing device illustrated FIG. 1.

The free end of each vane is connected to a support hoop 28,30. Each hoop 28,30 comprises a relatively rigid circular member. A first portion of each hoop 28,30 extends over the end of each of the vanes, and a second portion of each hoop 28,30 extends downwardly along the outer surface of each vane, as illustrated in FIGS. 2-4.

Figure 5:
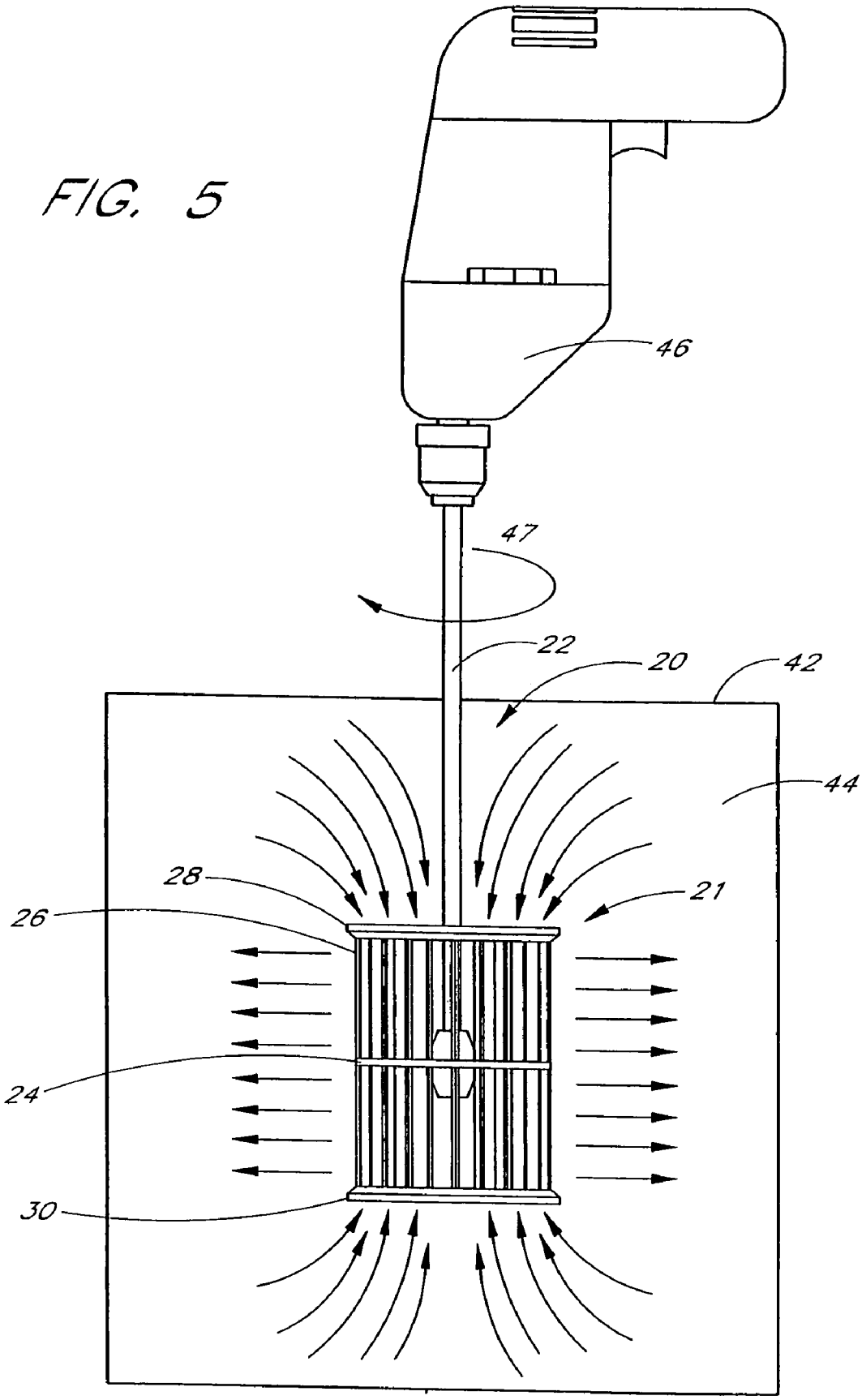
FIG. 5 illustrates use of the mixing device illustrated in FIG. 1 to mix a fluid in a container.

In use, referring to FIG. 5, a user obtains a container 42 containing fluid 44 to be mixed. This container 42 may comprise a paint can or any other container. The fluid 44 to be mixed may comprise nearly any type of fluid, such as a viscous fluid.

The user attaches the device 20 to a rotary drive means. As illustrated in FIG. 5, the drive means may comprise a drill 46. The user attaches the first end 32 of the shaft 22 to the drill 46, such as by locating the end 32 of the shaft in the chuck of the drill. Once connected, the user lowers the mixing cage 21 into the fluid 44 in the container 42. The user locates the mixing cage 21 below the top surface of the fluid. Once inserted into the fluid 44, the drill 46 is turned on, thus effectuating rotational movement of the mixing cage 21.

Another mixing device 120 of the type to which the invention is applicable is illustrated in FIGS. 6-10. This mixing device 120 is similar in many respects to the device 20 illustrated in FIGS. 1-5, except for the configuration of vanes thereof. Thus, the mixing device 120 comprises a cage-like structure having generally open ends. The device 120 includes a shaft 122 for rotation by a rotary drive means such as a drill (in similar fashion to that illustrated in FIG. 5). The shaft 122 connects to a central connecting plate or support 124. The shaft 122 has a first end 132 for connection to a rotary drive device and a second end 134 connected to the central plate 124. As illustrated, the second end 134 of the shaft 122 engages a hub 136 or similar adaptor member associated with the central plate 124. The second end 134 of the shaft 122 securely engages the central plate 124 and aids in preventing relative rotation of the shaft 122 with respect to the central plate 124.

As illustrated, the central plate 124 has an outer edge 143 defining a generally circular perimeter. The shaft 122 is connected to the plate 124 at a center thereof, whereby the mixing cage rotates generally symmetrically about an axis through the shaft 122.

A number of vanes 126 extend from one or both of a top side 138 and bottom side 140 of the central plate 124. As illustrated, vanes 126 extend from both the top and bottom side 138,140 of the plate 124. Each vane 126 has an inner edge 160 and an outer edge 162. The outer edge 162 of each vane 126 is located near the outer periphery of the central plate 124 and extends generally along a line perpendicular to the plate 124.

Figure 10:
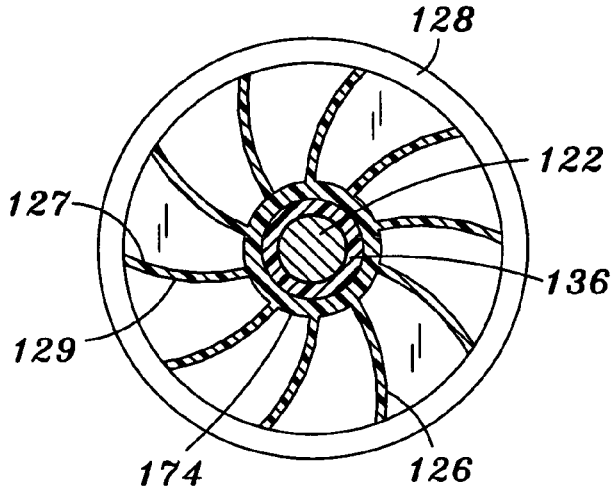
FIG. 10 is a cross-sectional view of the mixing device illustrated in FIG. 8 taken along line 10-10 therein.
Figure 9:
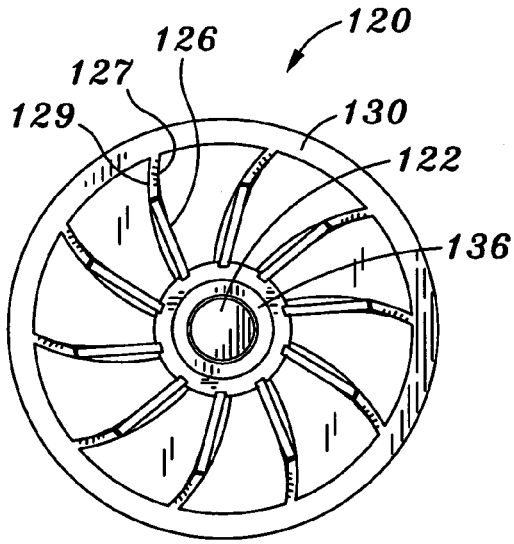
FIG. 9 is an end view of the mixing device illustrated in FIG. 8 taken in the direction of line 9-9 therein.

Referring to FIGS. 9 and 10, each vane 126 may be curved between its inner edge 160 and outer edge 162. The curved shape of each vane 126 causes it to have a concave surface 127 and a convex surface 129.

Figure 6:
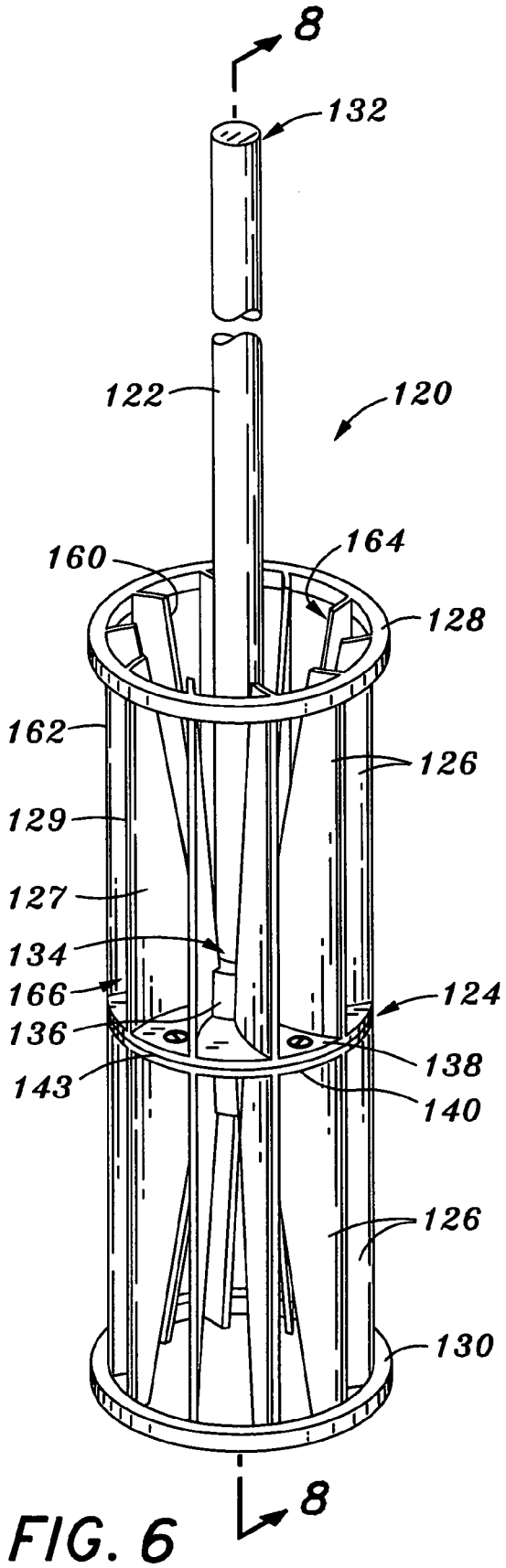
FIG. 6 is a perspective view of a mixing device in accordance with another embodiment of the invention.
Figure 8:
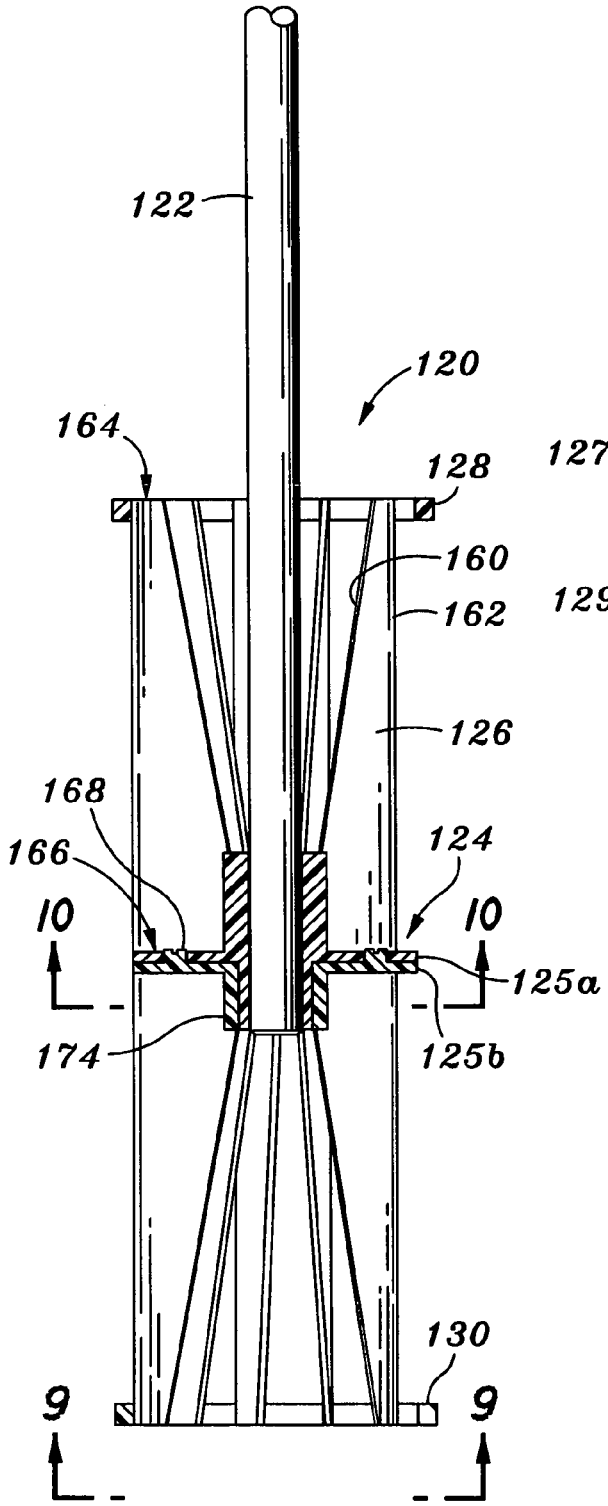
FIG. 8 is a cross-sectional view of the mixing device illustrated in FIG. 6 taken along line 8-8 therein.

Referring to FIGS. 6 and 8, each vane 126 has a first, top or distal end 164 and a second, bottom or proximal end 166. Each bottom or proximal end 166 is connected to the central plate 124. The top or distal end 164 is positioned remote from the central plate 124. As illustrated in FIG. 9, one end of the vanes defines a first opening and the other end of the vanes defines a second opening.

In the configuration illustrated, a connector connects the top ends 164 of the vanes 126. In the embodiment illustrated, a first hoop 128 connects the top ends 164 of the vanes 126 extending from the top side 138 of the central plate 124. A second hoop 130 connects the top ends 164 of the vanes 126 extending from the bottom side 140 of the plate 124. As illustrated, each hoop 128,130 is generally circular. Each hoop 128,130 extends outwardly beyond the outer edges 162 of the vanes 126.

Each vane 126 preferably extends inwardly from the outer periphery 143 of the support or central plate 124. The bottom end 166 of each vane 126 extends inwardly towards the center of the support or central plate 124 or towards the axis along which the shaft 122 extends by a distance which is greater than a distance the vane extends inwardly at its top end 164. In the embodiment illustrated, the width of the vanes between their inner edge 160 and outer edge 162 at a first end, such as the top end 164, is smaller than that of the vanes 126 at a second end, such as the bottom end 166.

Figure 7:
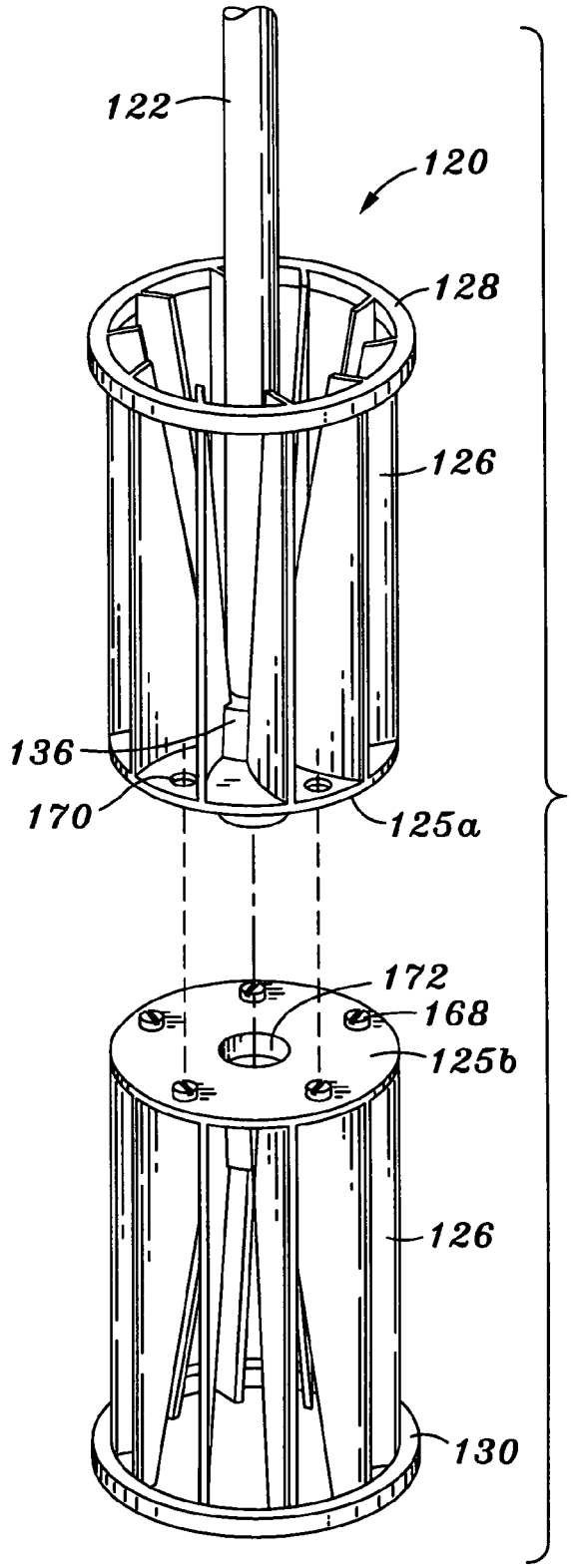
FIG. 7 is a perspective view of the mixing device illustrated in FIG. 6 in a separated state.

In a configuration in which the vanes 126 extend from both sides of the central plate 124, the central connecting plate 124 may comprise a top portion 125*a* and a bottom portion 125*b* which maybe selectively connected and disconnected. FIG. 6 illustrates the top and bottom portions 125*a*,125*b* in their connected position, while FIG. 7 illustrates them in their disconnected position. Referring to FIGS. 7 and 8, one set of vanes 126 extends outwardly from a top side of the top portion 125*a* of the central plate 124. Another set of vanes 126 extends outwardly from a bottom side of the bottom portion 125*b* of the central plate 124.

Means are provided for selectively connecting the top and bottom portions 125*a*,125*b* of the plate 124. This means may comprise one or more pins 168 extending from a top side of the bottom portion 125*b* of the central plate 124. These pins 168 are adapted to engage bores 170 provided in the top portion 125*a* of the central plate 124. In one or more embodiments, the pins 168 are slotted. This permits the pins 168 to be compressed when inserted into a mating bore 170. Once inserted, the biasing force generated as a result of the pin 168 being inserted into the bore 170 serves to retain the pin 168 securely with the top portion 125*a* of the plate 124.

In addition, the hub 136 extends from the bottom surface of the top portion 125*a* of the central plate 124. A mating port or bore 172 is provided in the bottom portion 125*b* of the central plate 124 for accepting the hub extension. The mating of the hub extension and port 172 aids in aligning the two portions of the mixing device 120. As illustrated in FIG. 8, in one or more embodiments, a hub 174 extends downwardly from the bottom side of the bottom portion 125*b* of the plate 124. The hub 174 is sized to accept the hub extension. The locations of the pins 168 around the port 172 serves to prevent rotation of the bottom portion of the mixing device relative to the top portion when the mixing device 120 is in use.

Use of the mixing device 120 of this embodiment of the invention is similar to that of the mixing device 20 described above and illustrated in FIG. 5. In particular, a rotary drive is coupled to the shaft 122 and the device 120 is located in a container containing material to be mixed. The device 120 is then rotated to mix the material.

When a mixing device (such as that described above) is used, a large amount of fluid and or other material may cling to the mixing device or be trapped by the device. For example when the mixing device is pulled upwardly from the paint or other material being mixed, a great deal of paint generally clings to the mixing device. In the case of the vaned mixing devices described above, this is due, in part, to the large surface area represented by the many vanes of the device. In addition, the vanes of such devices may trap paint globules, paint skin, contaminants or other materials.

One issue thus becomes cleaning of the device. If the paint or other material is left on the device, it may dry and harden. This may damage the device and/or interfere with its proper operation in the future.

One method for cleaning the device is to place the device in a cleaning solution. For example, for latex paint, the device may be placed in water. For oil based paint, the device may be placed in paint thinner or a similar cleaner. However, this requires the user to prepare a separate container of cleaning solution. Further, paint or other material may drip from the mixing device when it is moved from the paint container to the location where the device is to be cleaned. Lastly, because so much fluid may be retained on the device, the cleaning solution maybe very contaminated during the cleaning process, perhaps even requiring that the cleaning solution be prepared twice.

The present invention is a method and device for cleaning a mixing device. The method and device have particular applicability to rotary mixing devices, such as of the type detailed above. In general, the device of the invention is configured to at least partially contain a mixing device while the mixing device is moved, such as rotated, to expel fluid or other material therefrom.

Figure 11:
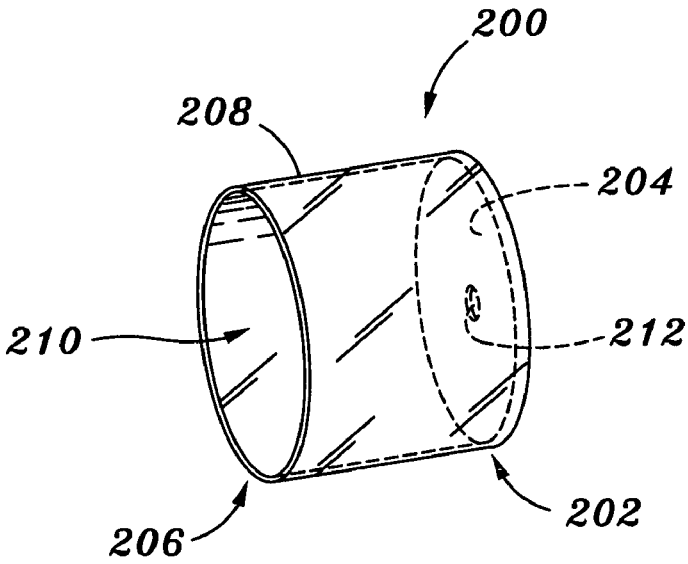
FIG. 11 is a perspective view of a cleaning shield in accordance with an embodiment of the invention.

One embodiment of a cleaning device is illustrated in FIG. 11. As illustrated, the device comprises a shield 200. In one embodiment, the shield 200 is a substantially hollow, cylindrical body 202. As illustrated, the body 202 has a first end 204 and a generally opposing second end 206. The first end 204 comprises a generally closed or solid base and which is generally circular in shape. A cylindrical wall 208 extends outwardly from the first end 204 to the second end 206. In a preferred embodiment, the cylindrical wall 208 is positioned at the periphery of the first end 204 or base. The second end 206 is generally open.

The shield 200 defines a generally open interior space 210. This space 210 is accessible through the open second end 206.

In one embodiment, at least one opening or aperture 212 is provided in the first end 204 or base. This aperture 212 is configured to accept a shaft there through, as described in more detail below.

In one embodiment, the shield 200 is constructed of plastic or other polymer material. The shield 200 may, for example, be formed in a molding process. The shield 200 may be generally transparent to permit the user to see there through.

Figure 12:
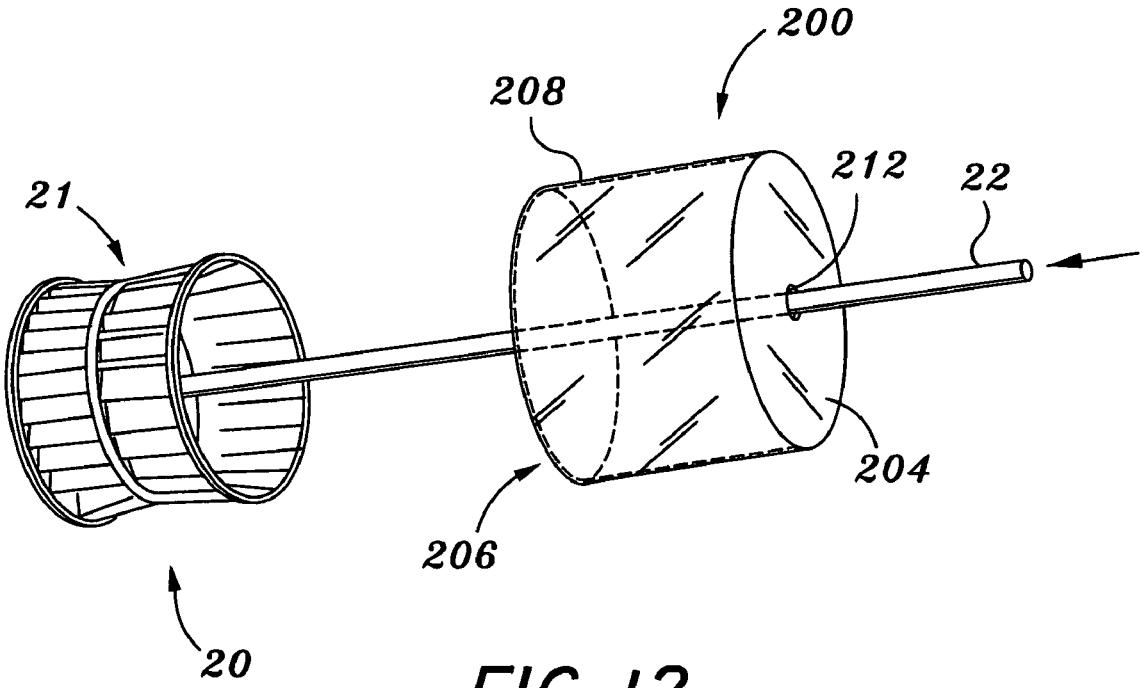
FIG. 12 is a perspective view of the cleaning shield illustrated in FIG. 11 after association with a mixing device.
Figure 13:
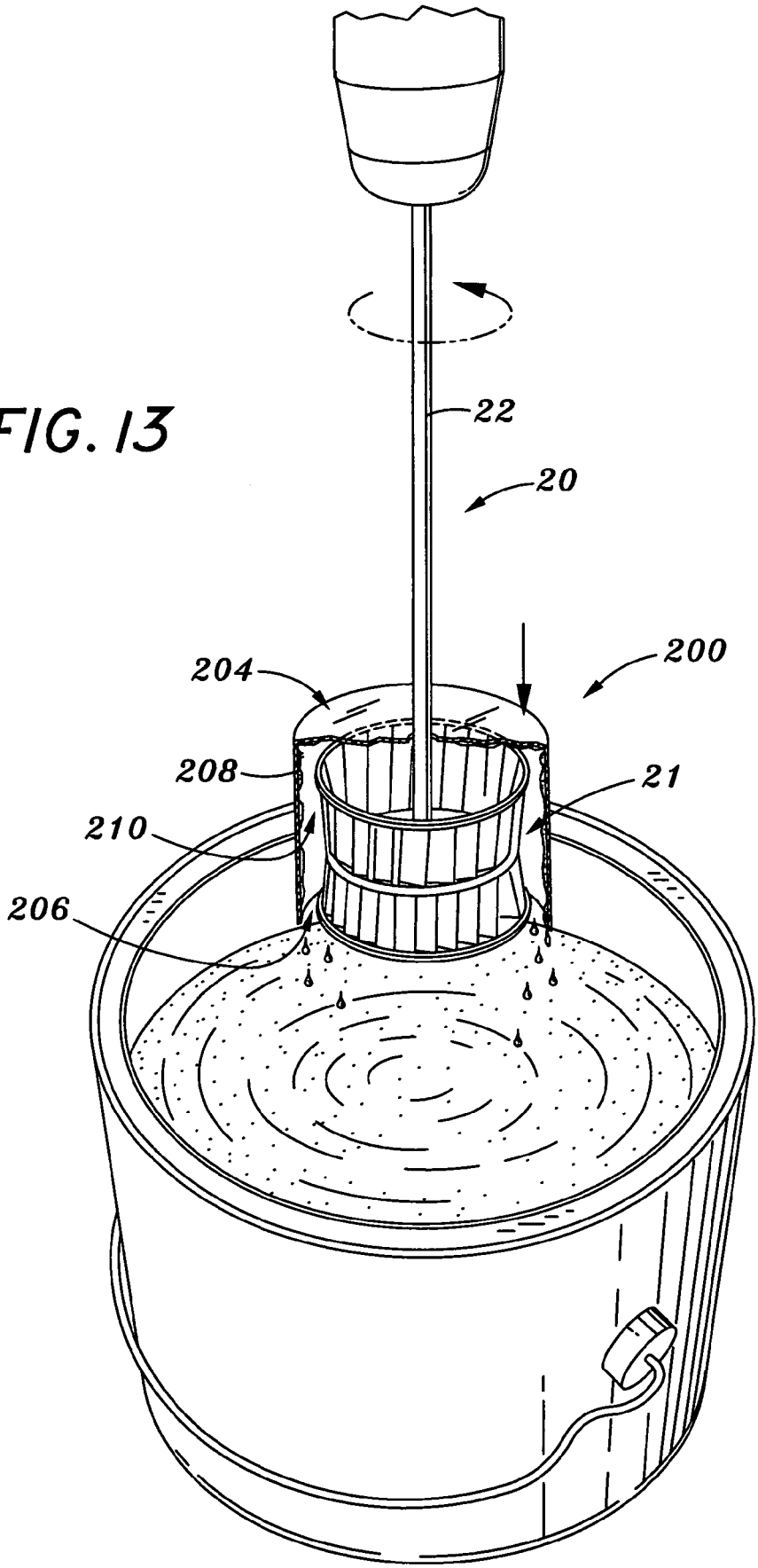
FIG. 13 illustrates the cleaning shield in a use position over a mixing cage or mixing portion of a mixing device.

A method of cleaning a rotary device will be described with reference to FIGS. 1 and 13. As illustrated in FIG. 12, the shield 200 is preferably associated with a mixing device 20. In a preferred embodiment, the shield 200 is inserted onto the free end of the driving shaft 22 of the mixing device 20. In particular, the free end of the driving shaft 22 is inserted through the aperture 212 in the shield 200.

In a preferred embodiment, the shield 200 is associated with the mixing device 20 before the mixing device 20 is engaged with the rotary drive and before the mixing device is used in a mixing process. The mixing cage or mixing portion 21 of the device 20 may then be lowered into the fluid to be mixed and used to mix the fluid. Preferably, during mixing, the shield 200 is maintained towards the second end of the shaft 22, away from the mixing cage 21 (and thus out of the fluid being mixed).

Once mixing is complete, the mixing cage 21 is preferably raised out of the fluid. The shield 200 may be lowered over the mixing cage 21, into the position illustrated in FIG. 13. At this time, the mixing cage 21 is preferably rotated. Centrifugal forces cause the fluid to be expelled radially outward form the mixing cage 21. This fluid advantageously impacts and/or collects upon the interior of the shield 200. As illustrated, if sufficient fluid is collected on the shield 200, it may drip or flow out the open second end 206. This fluid may be returned to the fluid container (such as paint container), as illustrated. Of course, the mixing device and shield might be located over a trash can or the like during this process as well, thus permitting the excess fluid and/or other material to be disposed of.

In this process, the majority of the fluid or other material which was retained on or in the mixing cage/portion after mixing is removed. The mixer may be sufficiently clean at that time to eliminate the need for further cleaning. Alternatively, the mixing device and shield can be further cleaned, such as by lowering them into a cleaning fluid and then rotating the mixer. This causes cleaning fluid to move over the vanes and other portions of the mixing cage, removing the paint or other material. In addition, the cleaning fluid impacts the shield, cleaning the shield. It is noted that this cleaning is accelerated because the bulk of the paint has been removed from the mixing device.

Alternatively, the mixing device may be removed from the rotary mixing device and the mixing device and shield may be manually cleaned. This may be accomplished by wiping or spraying the mixing device and/or shield, for example.

Once complete, the shield may be removed from the mixing device, such as by pulling it off of the drive shaft.

The size and shape of the shield 200 may vary. As illustrated in FIG. 12, the shield 200 is preferably sized large enough so that the mixing cage or other portion of the mixing device to be cleaned will fit in the interior thereof. Preferably, the shield 200 is sized slightly larger than the mixing device to be cleaned, so that fluid or other material which is expelled radially does not come back into contact with the rotating mixing device. The shield 200 may also not be sized too large, so as to prevent the fluid from being expelled and not caught by the shield 200. While the shield 200 is illustrated as generally circular in cross-section, the shield 200 may be oval, square, rectangular, irregular or of other shapes. Shapes causing the shield 200 to have folds, creases, sharp corners or the like are less preferred because paint or other material may be lodged in these areas.

It will be appreciated that the shield 200 maybe used with a variety of mixing devices. For example, the shield 200 may be large enough to accommodate various sized mixing devices. In other embodiments, the shield 200 may have a variety of configurations. For example, the shield 200 may be more elongate and have a small diameter when configured for use with a mixing device 120 such as that illustrated in FIG. 6.

Of course, the shield may be utilized with other types of mixing device. For example, the shield may similarly be utilized with mixing devices having mixing portions comprising blades, impellers or other types of mixing elements, and which are driven by shafts or other types of drive elements.

It will be understood that the above described arrangements of apparatus and the method therefrom are merely illustrative of applications of the principles of this invention and any other embodiments and modifications maybe made without departing from the spirit and scope of the invention as defined in the claims.

We claim:

1. A method of using a rotary mixing device comprising:

providing a rotary mixing device having a mixer portion and a driving shaft;

locating a cleaning shield upon said driving shaft;

connecting said driving shaft to a drive element;

locating said mixer portion in a fluid to be mixed;

rotating said mixer portion by rotating said shaft with said drive element;

removing said mixer portion from said fluid;

lowering said cleaning shield over said mixing portion of said mixing device; and rotating said mixer portion by rotating said shaft with said drive element, thereby expelling fluid from said mixer portion of said mixing device outwardly towards said shield.

2. The method of claim 1 wherein said shield comprises a generally cylindrical body having a first end and a second end, said first end being generally closed but defining an opening for said driving shaft and said second end being open.

3. The method of claim 2 wherein said body comprises a cylindrical wall extending from said first end to said second end.

4. The method of claim 1 wherein said shield is generally transparent.

* * * * *